US008177644B2

(12) United States Patent
Anderson et al.

(10) Patent No.: US 8,177,644 B2
(45) Date of Patent: May 15, 2012

(54) WAGERING GAME WITH FANTASY-SPORTS FEATURE

(75) Inventors: Peter R. Anderson, Glenview, IL (US); Rory L. Block, Carson City, NV (US); Joel R. Jaffe, Glenview, IL (US); Shridhar P. Joshi, Naperville, IL (US); Vincent Chan, Vancouver (CA); Patrick H. Kelley, Evanston, IL (US); Richard T. Schwartz, Chicago, IL (US); Byron A. Uytiepo, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 12/377,531

(22) PCT Filed: Aug. 15, 2007

(86) PCT No.: PCT/US2007/018172

§ 371 (c)(1),
(2), (4) Date: Jul. 26, 2010

(87) PCT Pub. No.: WO2008/021448

PCT Pub. Date: Feb. 21, 2008

(65) Prior Publication Data

US 2010/0285857 A1 Nov. 11, 2010

Related U.S. Application Data

(60) Provisional application No. 60/837,971, filed on Aug. 16, 2006, provisional application No. 60/858,153, filed on Nov. 9, 2006.

(51) Int. Cl.
*A63F 9/24* (2006.01)

(52) U.S. Cl. ..... 463/40

(58) Field of Classification Search ..... 463/4, 40, 463/42

See application file for complete search history.

(56) References Cited

U.S. PATENT DOCUMENTS

| | | | | |
|---|---|---|---|---|
| 5,971,854 | A * | 10/1999 | Pearson et al. | 463/41 |
| 7,364,509 | B2 * | 4/2008 | Slade | 463/40 |
| 7,775,880 | B2 * | 8/2010 | Downes | 463/28 |
| 2002/0068633 | A1 | 6/2002 | Schlaifer | |
| 2002/0153656 | A1 * | 10/2002 | Maksymec et al. | 273/138.1 |
| 2004/0204217 | A1 * | 10/2004 | Herman | 463/16 |
| 2004/0266530 | A1 | 12/2004 | Bishop | |
| 2005/0102223 | A1 | 5/2005 | Vlazny et al. | |

(Continued)

OTHER PUBLICATIONS

Written Opinion corresponding to co-pending International Patent Application Serial No. PCT/US2007/18172, United States Patent Office, dated Aug. 26, 2008.

(Continued)

*Primary Examiner* — David L Lewis
*Assistant Examiner* — Eric M Thomas
(74) *Attorney, Agent, or Firm* — Nixon Peabody LLP

(57) ABSTRACT

A gaming system and method of conducting a wagering game having a fantasy-sports feature on a gaming system is disclosed. A wager is received from a user to play the wagering game. A roster having one or more player is created, via user selection. A projected team score and an actual team score for the created roster are determined. A ratio is calculated for the actual team score to the projected team score. An award is provided to the user if the calculated ratio meets a predetermined criterion.

24 Claims, 7 Drawing Sheets

U.S. PATENT DOCUMENTS

2006/0183548 A1 8/2006 Morris et al.

OTHER PUBLICATIONS

International Search Report corresponding to co-pending International Patent Application Serial No. PCT/US2007/18172, United States Patent Office, dated Aug. 26, 2008.

Fred M. Faour, "Internet Takes Position as Designated medium for Fantasy-League Baseball to Steal Home: Log Me on to the Ballgame." Houston Chronicle, Mar. 27, 1998.

Fantasy Sports Central, archived Apr. 2, 2004, retrieved from http://fantasysportscentral.com/membership.asp, printed Feb. 9, 2009.

Product Sheet for "Sports Season Rapid Bet Live" by Progressive Gaming International Corporation (2 pages).

Progressive Gamming Expects Regulatory Approval for Rapid Bet Live Initiative before NCAA Division I Men's Basketball Tournament, http://phx.corporate-ir.net/phoenix.zhtml?c=79441&p=irol-newsArticle_printed&ID=812750, printed Mar. 3, 2006.

Progressive Gamming International Receives Approval for Field Trial for Rapid Bet Live, http://phx.corporate-ir.net/phoenix.zhtml?c=79441&p=irol-newsArticle_printed&ID=82202, printed Mar. 3, 2006.

International Preliminary Report on Patentability corresponding to co-pending International Patent Application Serial No. PCT/US2007/18172, United States Patent Office, dated Jan. 5, 2009.

* cited by examiner

WAGERING GAME WITH FANTASY-SPORTS FEATURE

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to wagering games having a fantasy-sports feature.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines.

In recent years fantasy gaming, and particularly fantasy-sports gaming has become increasingly popular. Because of the continual need to develop new wagering games and gaming features to generate player appeal and excitement, it would be desirable to incorporate fantasy gaming into various wagering games to satisfy the demands of players and operators.

SUMMARY OF THE INVENTION

According to one aspect of the present invention, a method of conducting a wagering game having a fantasy-sports feature on a gaming system is disclosed. The method comprises receiving a wager from a user to play the wagering game. A roster having one or more player is created, via user selection. A projected team score and an actual team score for the created roster are determined. A ratio is calculated for the actual team score to the projected team score. An award is provided to the user if the calculated ratio meets a predetermined criterion.

According to yet another aspect of the invention, a computer readable storage medium is encoded with instructions for directing a gaming system to perform the above method.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
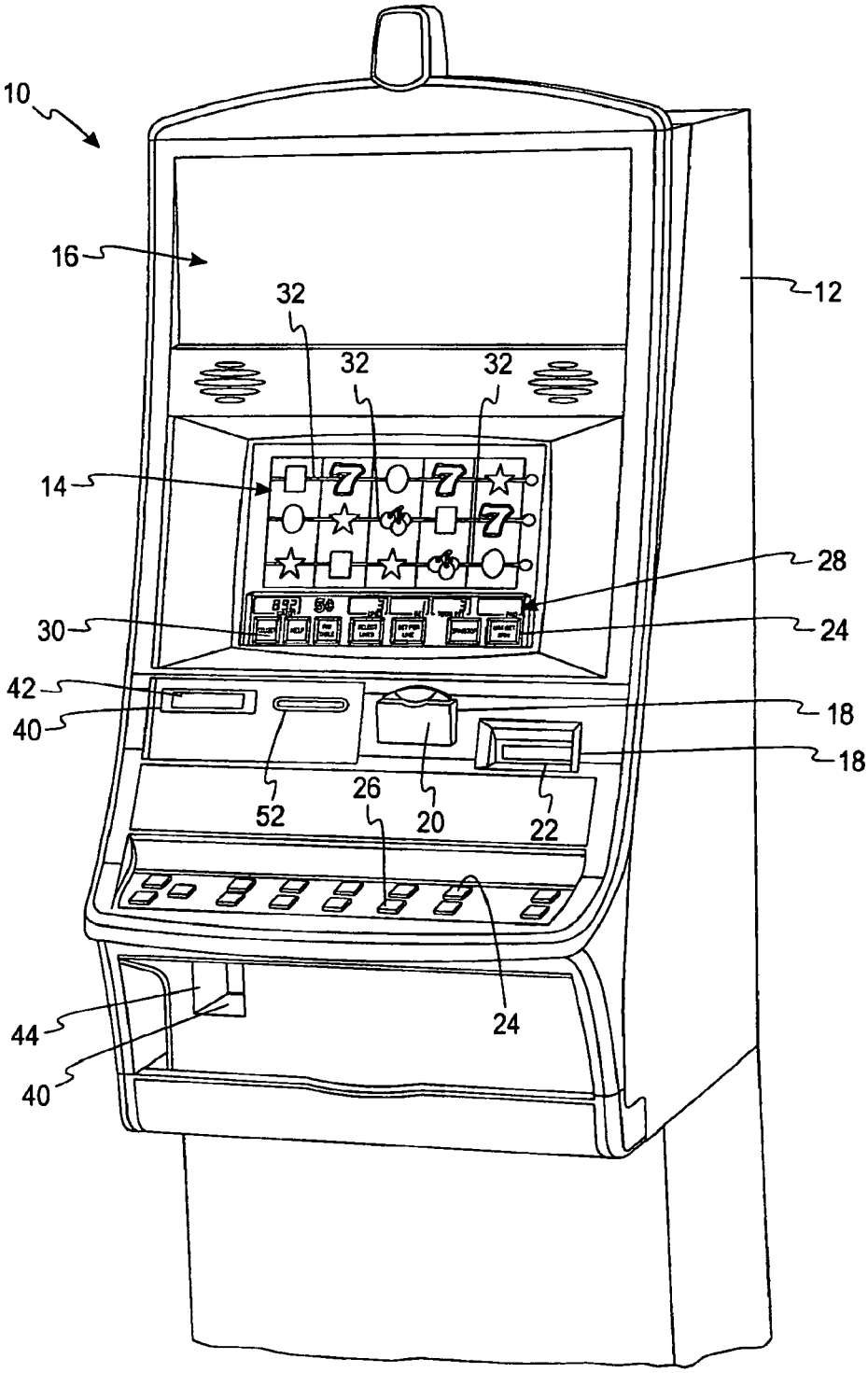
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
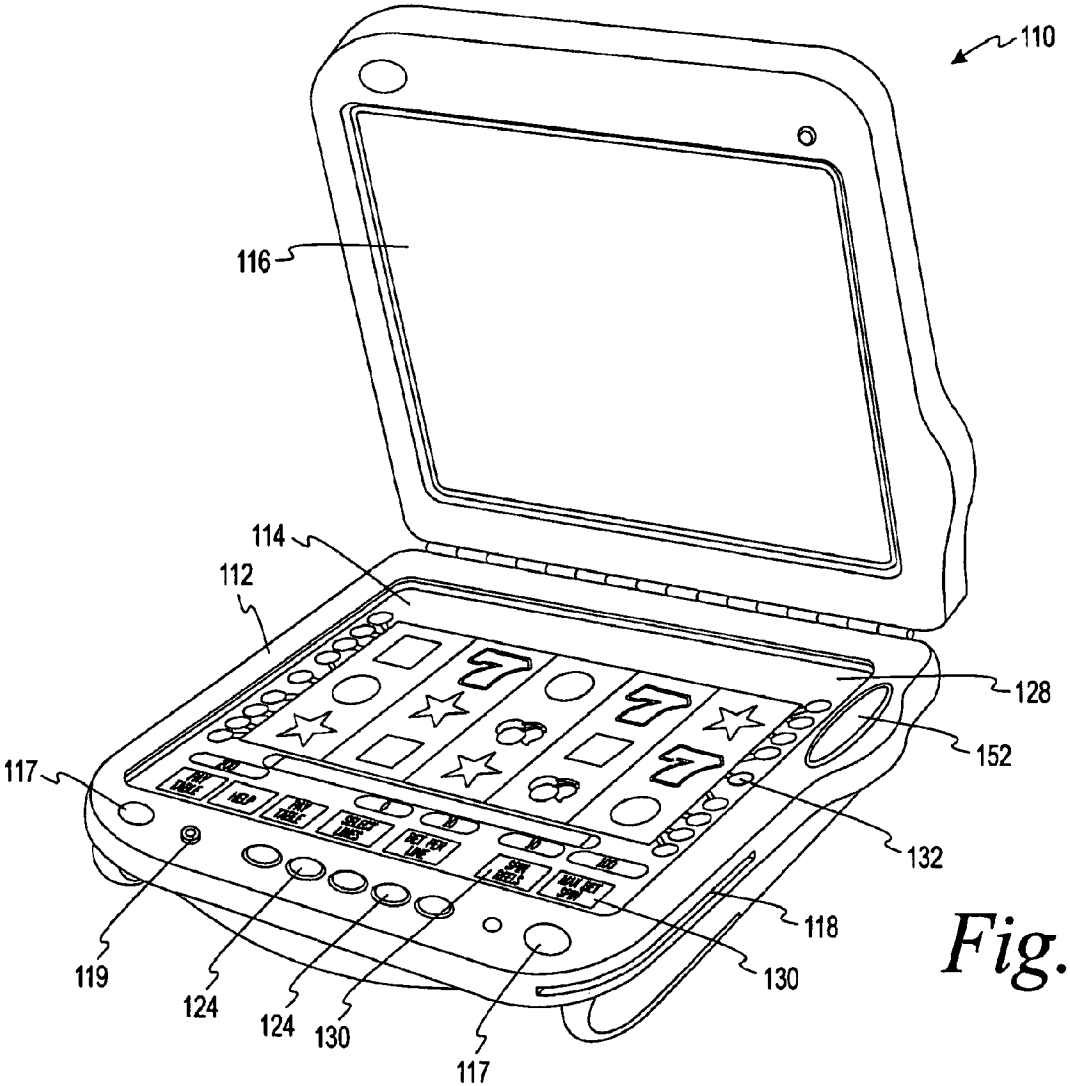
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
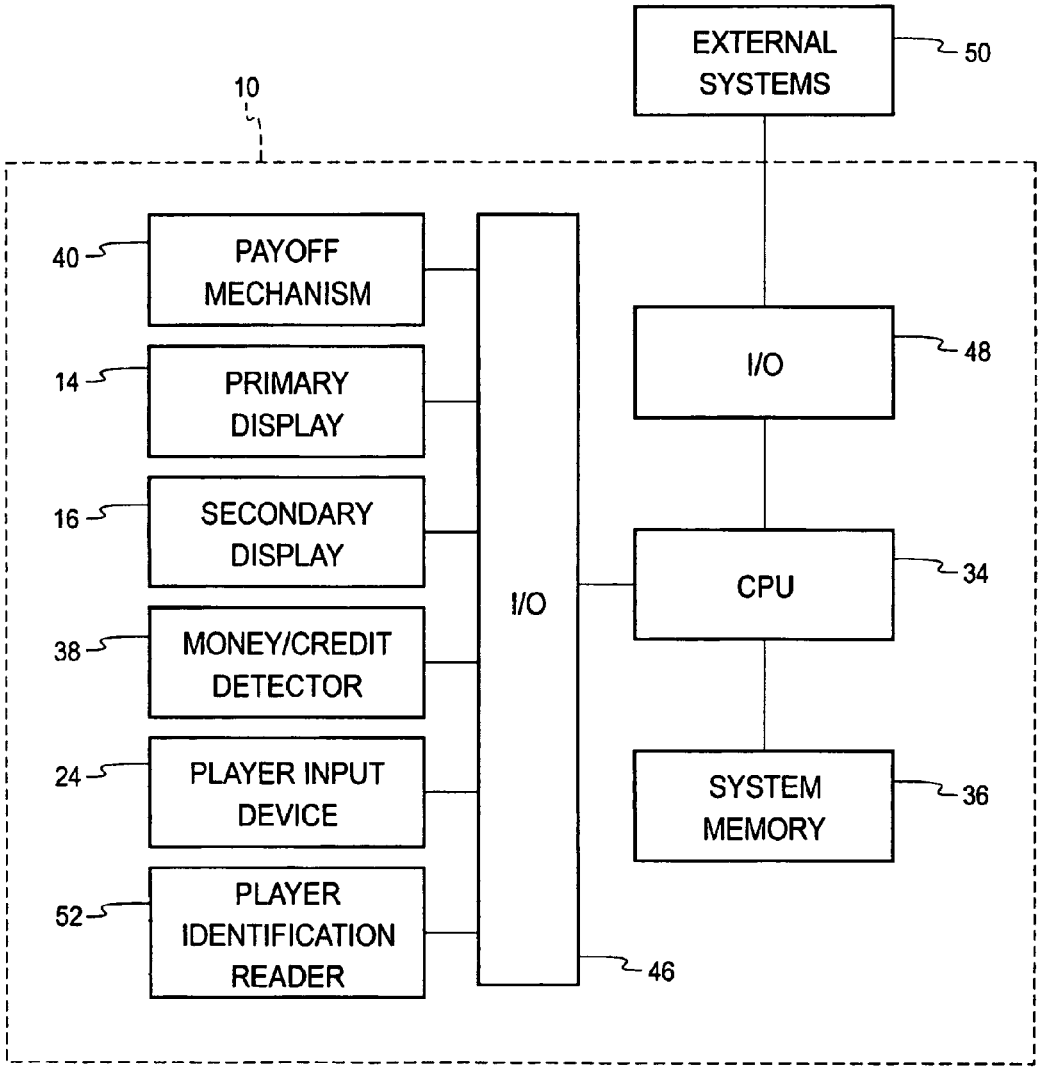
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10, 110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10, 110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

The above gaming machines 10, 110 may be used to interact with a wagering game having a fantasy-gaming feature. The fantasy-gaming feature may relate to, for example, a sporting event or any other event or activity having statistical information that can be tracked. In embodiments in which the fantasy-gaming feature relates to sporting events, various types of game play and wagering options may be provided. For example, a user may be prompted to select particular players, positions, teams, etc. or to select from particular divisions, conferences, leagues, etc. In these embodiments, the fantasy-gaming feature can monitor one or more tracked statistics and determine a resultant winner or winners as will be described in greater detail below with respect to FIGS. 3-5.

The tracked statistics are utilized to resolve the user's wager and may be tracked over a period of time. For example, the statistics used to resolve the user's wager may be tracked over a period of seconds, minutes, hours, days, weeks, months, or even years. The statistics may be tracked over a single play or group of plays, or over one or more innings, quarters, periods, halves, or races. Additionally or alternatively, the statistics may be tracked over a single game or group of games, a season or portion(s) thereof, or any time period desired by the operator.

Figure 3:
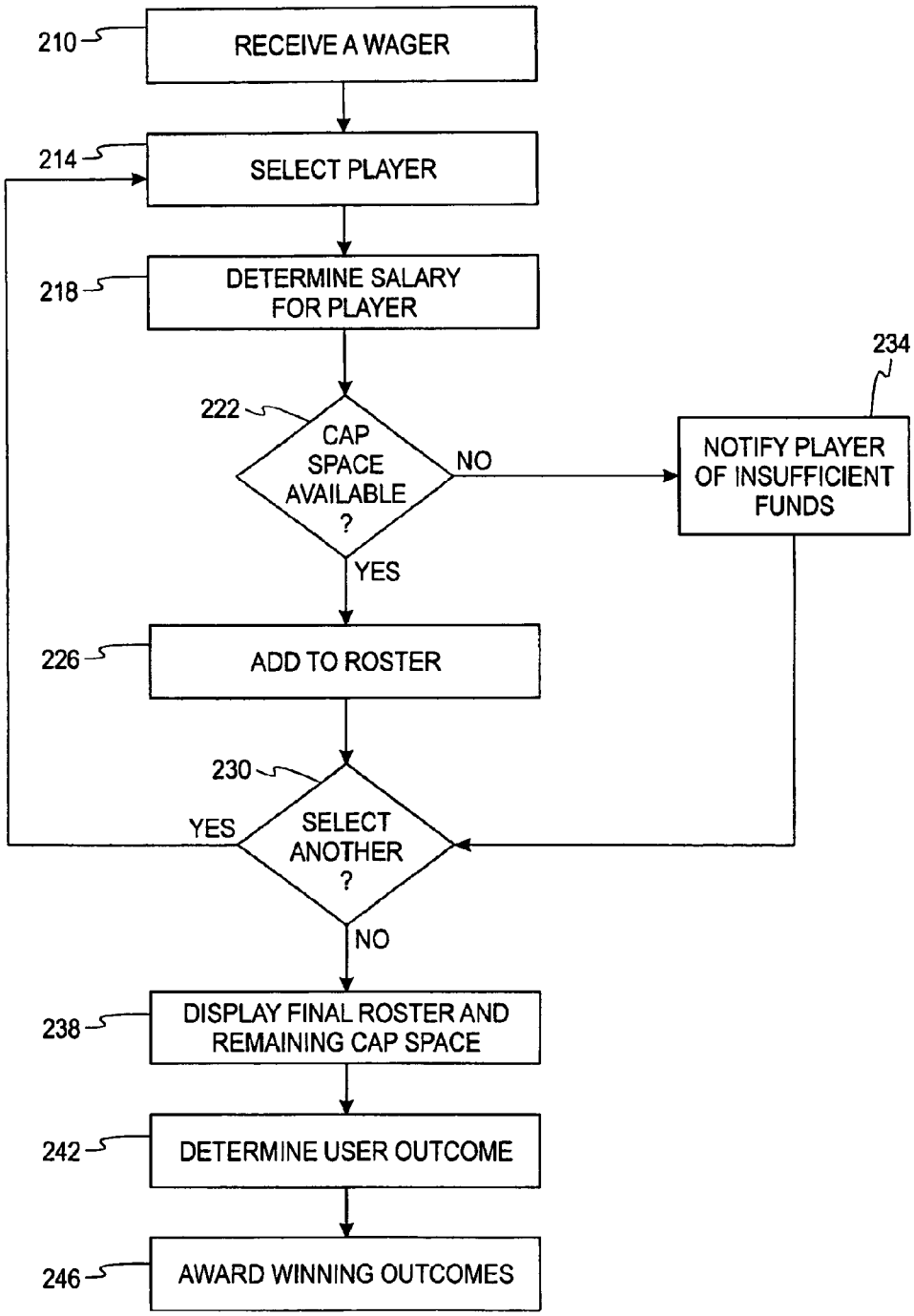
FIG. 3 is a method for conducting a wagering game having a fantasy-sports feature, according to one embodiment of the present invention.

Referring now to FIG. 3, a method for conducting a wagering game having a fantasy-sports feature is illustrated. The wagering game begins when a wager is received from a user at step 210. The wager can be received by the value input device 18, 118 provided with the gaming machine 10, 110. The user may then be prompted to select a player (e.g., an athlete, horse, car, etc.) at step 214 from a list of potential players.

In embodiments where a salary cap is utilized, the player's salary is determined at step 218. In salary-cap fantasy gaming, the user is provided with a predetermined budget with which to buy players to fill the user's roster. The cap of the budget is the maximum value of the predetermined budget provided to the user. The predetermined budget may be a standard value or may vary depending on the wager provided by the user.

Accordingly, where a salary cap is utilized, a determination is made, at decision box 222, whether salary-cap space is available. This determination is made by adding the salary of the player to be added to the salaries of the other players on the roster to determine the overall salary for the roster. The overall salary for the roster is then compared to the salary cap and, if the overall salary is less than the salary cap, the player is added to the roster at step 226. A determination is made, at decision box 230, whether the user desires to select another player to add to the roster. Where the overall salary would be greater than the salary cap, the user is notified at step 234 of the insufficient cap room and a determination is made, at decision box 230, whether the user desires to select another player to add to the roster.

Once a determination is made, at decision box 230, that a user does not desire to select another player to add to the roster (or the roster is full), the final roster and the remaining cap space (if any) is displayed to the player at step 238. As will be explained in greater detail below, the outcome of the user's roster is determined at step 242 and an award is provided for winning outcomes at step 246.

The outcome of the user's roster may be determined in a variety of ways. For example, the outcome may be determined based on a particular achievement of the players on the roster (e.g., total home-runs hit, total three-pointers made, total tackles, etc.). Alternatively, the outcome may be determined based on the greatest particular achievement by any one player on the roster (e.g., highest strike outs, highest rebounds, highest completions, etc.). Alternatively still, the outcome may be determined based on the totality of several particular achievements. The various particular achievements may be adjusted and/or weighted in any way desirable to the owner or operator. For example, where the roster is composed of a plurality of baseball players, the formula may be:

$$(\text{hits}\times 1)+(\text{home runs}\times 5)+(\text{stolen bases}\times 2)-(\text{strike-outs}\times 1)$$

Additionally, bonus amounts or awards may be provided for extra special plays such as, for example, a grand slam or a kickoff return for a touchdown. Achievements such as those described above are generally tracked by a number of various agencies. For example, statistics for use in computation of the outcomes for a particular roster may be purchased or obtained from STATS, Inc. of Morton Grove, Ill.

The salary for a particular player can be any salary less than the salary cap. In some embodiments, the salary of a player is predetermined with relation to the player's expected or average statistics. The salary of a player may be adjusted for a variety of reasons. For example, a player's salary may be increased as more and more users select the particular player or based on the spot the player is selected within a roster. The predetermination and/or adjustment of a player's salary can be determined automatically, by a processor in communication with the gaming machine, or manually, by a handicapper or other individual.

In some embodiments, the selection information may be provided to various individuals or used within an establishment (e.g., a casino) to assist with handicapping and odds making. For example, if during a particular fantasy gaming session various users are selecting Player A as there top overall pick, this information might be used to adjust the odds on Player A (or his team) for non-fantasy wagers. In this example, a handicapper or odds-maker may decide that although they see Player A as a 5:1 chance for a particular wager, the potential wagerers believe Player A to be closer to a 2:1 chance. As such, the odds on Player A might be adjusted to 3:1 to increase the potential for profit by the establishment.

Figure 4:
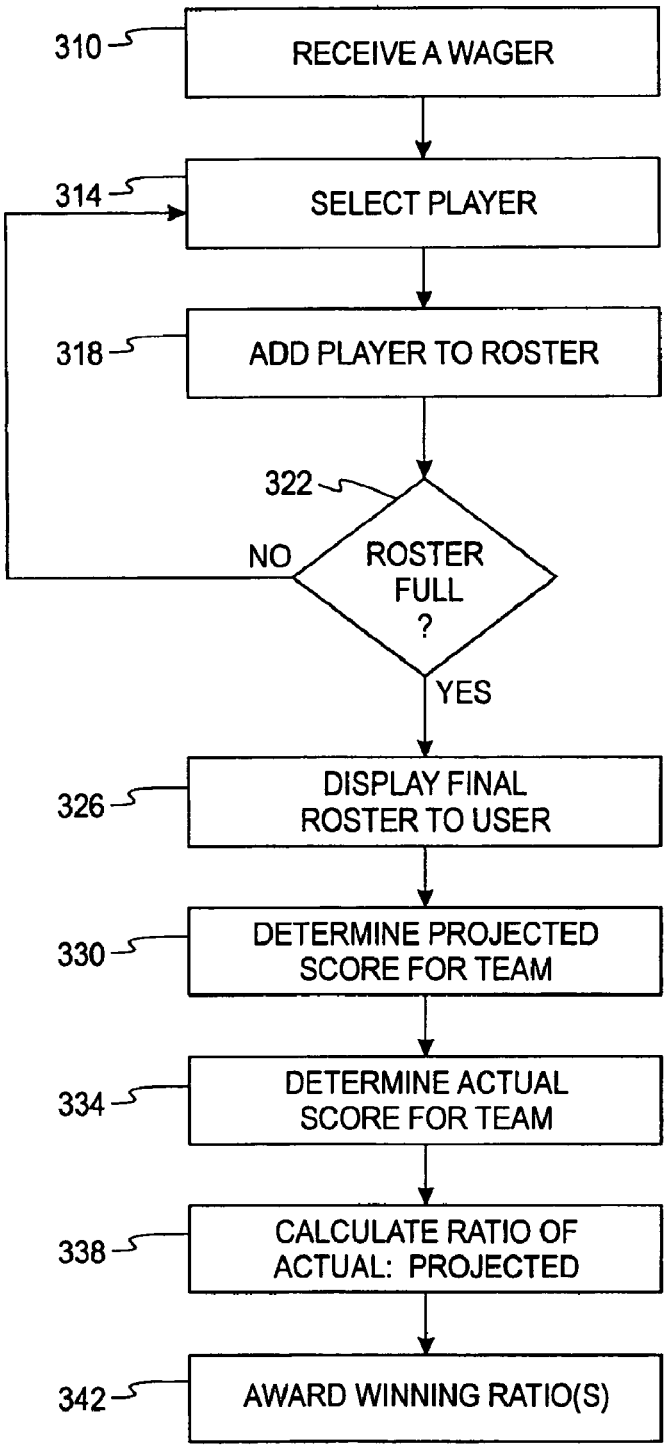
FIG. 4 is a method for conducting a wagering game having a fantasy-sports feature, according to another embodiment of the present invention.

Turning now to FIG. 4, a method for conducting a wagering game having a fantasy-sports feature is illustrated. The wagering game begins when a wager is received from a user at step 310. The user may then be prompted to select a player at step 314 from a list of potential players. The selected player is then added to the roster at step 318 and a determination is made, at decision box 322, whether the roster is full. If the roster is not full, the user is again prompted to select a player at step 314. Once the roster is full, however, the final roster is displayed at step 326.

At step 330 a projected score for the user's selected team is determined. The projected score is a predictive score that the user's team would generally be expected to achieve. The projected score may be based on the average score the players on the user's team have achieved over a period of time or may be handicapped especially for the particular event the user is selecting the players for. In some embodiments, the player's projected value is displayed to the user prior to the user being prompted to select a player. In these embodiments, the user is able to determine whether he or she believes the player will exceed their projected score. The user can then select his or her team to try and create an entire roster that exceeds the projected score for that roster.

At step 334 the actual score for the user's selected team is determined. The ratio of the actual score to the projected score is calculated at step 338. Where the calculated ratio exceeds a threshold value, the user is awarded an award at step 342. The award may increase the greater the calculated ratio becomes. For example, an award may be provided for a ratio greater than 1. An award of 2× may be provided for a ratio greater than 1.5 while an award of 3× may be provided for a ratio greater than 2. In some embodiments, the awards increase exponentially as the ratio increases.

Alternatively, in some embodiments an award is provided when a user's ratio is greater than a "house" ratio, which is the ratio achieved by a house-selected roster. In other embodiments, an award is provided only when a user's ratio exceeds that of a particular percentage of the other user's wagering on the same event. For example, a user may be provided an award only if the user's ratio is within the top 25% of the entrants for the event.

The user's ratio can be determined in real time as the event proceeds. Thus, the user will be able to observe his or her ratio increase as the event continues, increasing user excitement. Additionally or alternatively, the user's ratio can be displayed with regard to the other users' ratios on the users' screens or on a community display. The display may present the top ratios or may show all of the users that are currently "in the money."

Alternatively or additionally, absolute numeric values are used—instead of or in addition to a ratio—to rank the users and determine whether an award has been achieved. In these embodiments, a user may be provided an award when the user's actual score exceeds the projected score by a predetermined amount (i.e., 50 points). The award is increased the further the user's actual score exceeds the projected score. According to one embodiment, the award is equal in value to the number of points the user's actual score exceeds the projected score.

Figure 5:
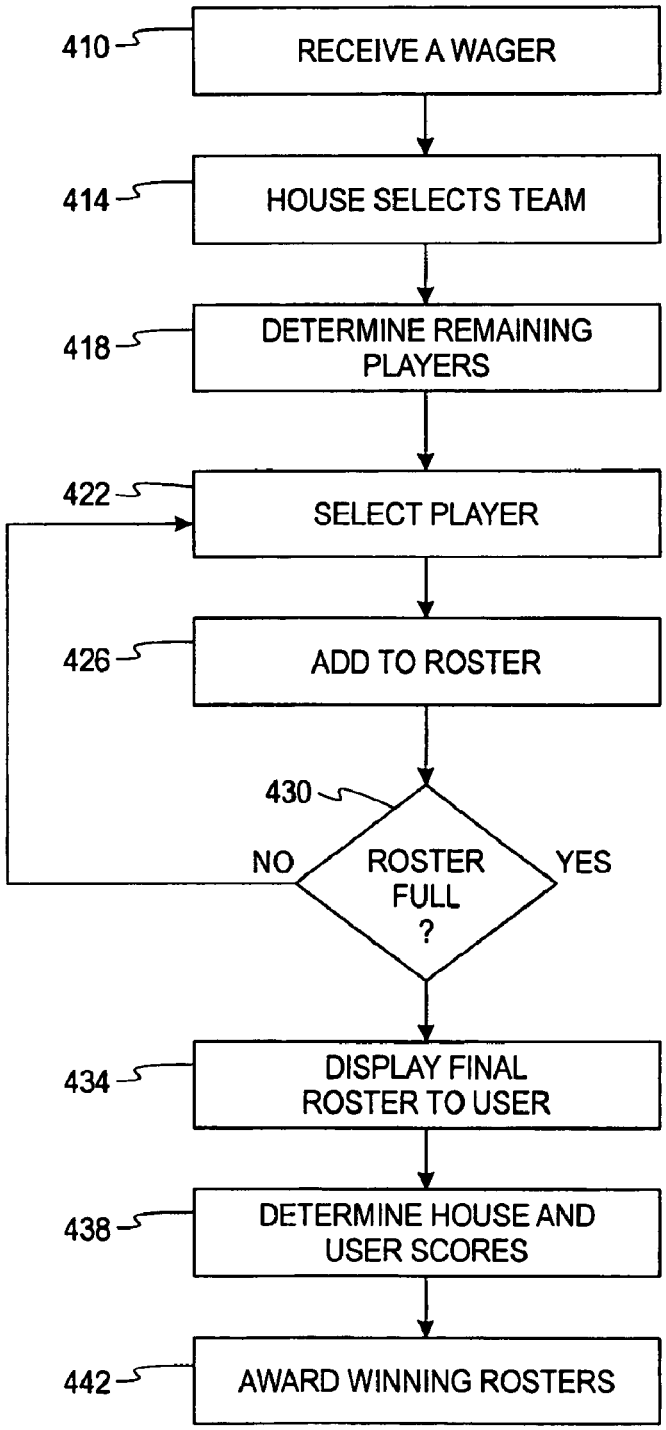
FIG. 5 is a method for conducting a wagering game having a fantasy-sports feature, according to still another embodiment of the present invention.

Referring now to FIG. 5, a method for conducting a wagering game having a fantasy-sports feature is illustrated. The wagering game begins when a wager is received from a user at step 410. The "house" then selects a team at step 414. In this embodiment, the house selects the team that the house believes to be the optimum roster for the particular event. In some embodiments, the players selected by the house cannot be selected by the users for their rosters. In these embodiments, the remaining players are determined (i.e., the non house-selected players) and displayed to the user at step 418.

Once the house team has been selected the user may then be prompted to select a player at step 422 from a list of remaining players. The selected player is then added to the roster at step 426 and a determination is made, at decision box 430, whether the roster is full. If the roster is not full, the user is again prompted to select a player at step 422. Once the roster is full, however, the final roster is displayed at step 434.

At step 438 the "house" score and the user score are determined based on the predetermined criteria. An award is provided at step 442 for all winning user rosters. In some embodiments, a user's roster is considered a winning roster when the score for the user's roster ties or exceeds the house score.

As discussed above, in some embodiments of the present invention, the players selected by the house cannot be selected by a user. According to other embodiments, the remaining players are any players that have not been selected by the particular user. In still other embodiments, one or more "top picks" may be removed from the player list and therefore cannot be selected by a user. The "top pick" may be removed based on a high projected score for the player. The one or more "top picks" may be removed based on the overall projected scores for all players, for all players at a particular position, for all players on a particular team, etc. These "top picks" may be used to automatically form the house-selected team. Alternatively, these "top picks" may simply be non-selectable to try and increase the diversity of players on various user-selected rosters.

Figure 6:
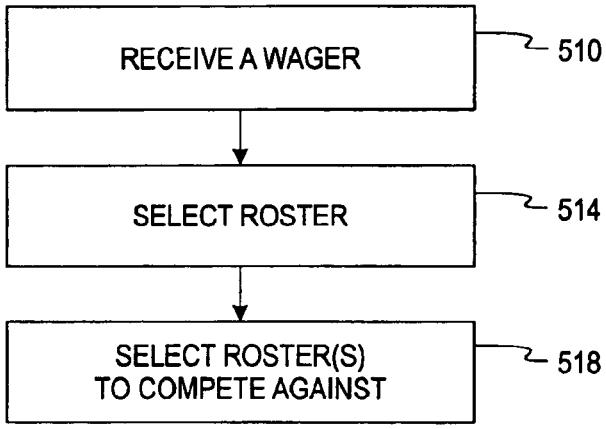
FIG. 6 is a method for conducting a wagering game having a fantasy-sports feature, according to yet another embodiment of the present invention.

Referring now to FIG. 6, a method for conducting a wagering game having a fantasy-sports feature is illustrated. The wagering game begins when a wager is received at step 510. The player is then prompted to select a roster at step 514. The roster may be any predetermined number of players depending on the game time, skill level, and breadth sought to be included within the wagering game. For example, the roster may include one quarterback, one running back, and one wide receiver. Rosters for the user to compete against may be predetermined or may be formed from the remaining players after the user has selected their roster at step 514. Once the user has selected their roster, the user decides which of a plurality of rosters to compete against at step 518.

In some embodiments, the user competes against all of the generated rosters. The various rosters may be handicapped individually or a user may earn awards based on the total number of rosters they beat, regardless of which rosters they are.

Figure 7:
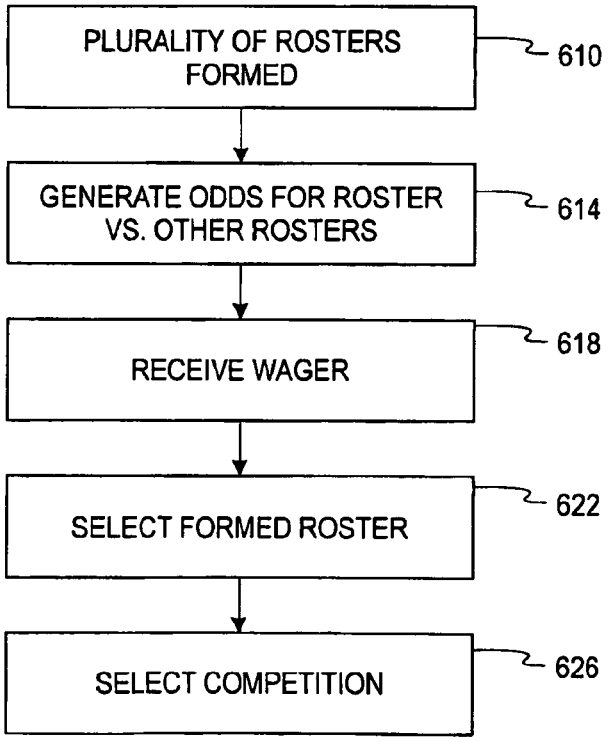
FIG. 7 is a method for conducting a wagering game having a fantasy-sports feature, according to another embodiment of the present invention While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

Referring also to FIG. 7, a method for conducting a wagering game having a fantasy-sports feature is illustrated. A plurality of roster may be formed at step 610 and the odds of winning for the various rosters may be generated at step 614. The odds of winning may be based on the odds of beating any player selected team or may be the odds of beating another one of the plurality of formed rosters. Table 1 provides an example of the various odds that might be generated for a wagering game having four rosters.

TABLE 1

| Opponents | Odds |
|---|---|
| Team A vs Team B | 2:1 |
| Team A vs Team C | 4:1 |
| Team A vs Team D | 8:1 |
| Team B vs Team C | 2:1 |
| Team B vs Team D | 4:1 |
| Team C vs Team D | 2:1 |

Once the odds have been generated, a wager is received from a user at step 618 and the user is then allowed to select one of the formed rosters at step 622. In the above example, the user may select Team C as their roster of choice. The user then selects one or more of the competitors to compete against at step 626. In the above example, the user may believe that Team C will beat both Team A and Team D. Thus, the user will select Teams A and D as the competition.

Where multiple teams are selected to compete against, the user's wager may be divided evenly among all of the selected competition or an additional wager may be required to select a second, third, etc. team to compete against.

According to some embodiments, the wagering game of FIG. 7 may be conducted using money line betting as opposed to an odds-based system. In other embodiments, a point spread may be used to handicap the various teams.

For purposes of describing the present invention, embodiments have been illustrated wherein a user selects one or more "players" to create the user's roster. However, it should be noted that the term "player" is used to describe individual players/athletes, teams, positions, leagues, divisions, conferences, jockeys, horses, cars, dogs, events, etc.

The above wagering games may also include a local-area and/or wide-area progressive jackpot. A progressive jackpot may be earned for achieving a predetermined threshold or may be awarded when a user finishes ranked in a corresponding finish place for a particular event or over the course of a season or tournament.

Each of these embodiments and obvious variations thereof is contemplated as falling within the spirit and scope of the claimed invention, which is set forth in the following claims.

What is claimed is:

1. A method of conducting a wagering game having a fantasy-sports feature on a gaming system, the method comprising:

receiving a wager from a user to play the wagering game;

creating, via user selection, a roster having one or more players;

displaying on a display of the gaming system the created roster;

determining a projected team score for the created roster;

determining an actual team score for the created roster;

calculating a ratio for the actual team score to the projected team score; and providing an award to the user if the calculated ratio meets a predetermined criterion.

2. The method of claim 1, wherein the predetermined criterion is the calculated ratio being a value equal to or exceeding one.

3. The method of claim 1, wherein creating a roster comprises:

determining a salary for each player of the one or more players;

computing an overall salary by adding the salaries for each player of the one or more players; and determining that the overall salary is less than or equal to a salary cap value.

4. The method of claim 1, wherein determining a projected team score comprises calculating an average score of the one or more players.

5. The method of claim 1, wherein the ratio is calculated in real time.

6. The method of claim 1, wherein the predetermined criteria is the calculated ratio being a value exceeding a ratio calculated for a house-selected roster having one or more house-selected players.

7. The method of claim 1, further comprising:

communicating the created roster to an odds maker; and adjusting a handicap value based on the created roster.

8. The method of claim 1, wherein the value of the award is increased or decreased commensurate with the value of the ratio.

9. A gaming machine comprising:

a value input device configured to receive a wager;

a roster input device configured to receive a roster selection from a user, the roster having one or more players;

a display configured to display the roster; and a controller operative to:

determine a projected team score for the selected roster, determine an actual team score for the selected roster, calculate a ratio for the actual team score to the projected team score, and award an award to the user if the calculated ratio meets a predetermined criterion.

10. The gaming machine of claim 9, wherein the predetermined criterion is the calculated ratio being a value equal to or exceeding one.

11. The gaming machine of claim 9, wherein the controller is further operative to:

determine a salary for each player of the one or more players on the roster, compute an overall salary of the roster by adding the salaries for each player of the one or more players, and determine if the overall salary is less than or equal to a salary cap value.

12. The gaming machine of claim 9, wherein the projected team score comprises an average score of the one or more players.

13. The gaming machine of claim 9, wherein the ratio is calculated in real time.

14. The gaming machine of claim 9, wherein the predetermined criteria is the calculated ratio being a value exceeding a ratio calculated for a house-selected roster having one or more house-selected players.

15. A method of conducting a wagering game on a gaming machine, the method comprising:

determining a projected score for each player of a plurality of players;

receiving a wager from a user to play the wagering game;

creating, via user selection, a roster having one or more players from the plurality of players;

displaying on a display of the gaming machine the created roster;

calculating a projected team score for the created roster using the projected scores for each player on the created roster;

determining an actual team score for the created roster;

comparing the actual team score to the projected team score; and providing an award to the user if the actual team score meets a predetermined criterion.

16. The method of claim 15, wherein the predetermined criterion is the actual team score exceeding the projected team score by at least a predetermined amount.

17. The method of claim 15, wherein the predetermined criterion is the actual team score exceeding the projected team score by at least a predetermined percentage.

18. The method of claim 15, wherein calculating the projected team score comprises adding each of the projected scores for each of the players on the roster.

19. The method of claim 15, wherein the projected team score is estimated, at least in part, from an average of the projected scores for each of the players on the roster achieved over a period of time prior to the completion of the roster.

20. The method of claim 16, wherein the size of the award is determined by the amount the actual team score exceeds the projected team score.

21. The method of claim 1, wherein the projected team score is a predictive score estimated, at least in part, from a prior average score the players on the roster achieved over a period of time prior to the completion of the roster.

22. The method of claim 21, wherein the actual team score is calculated, at least in part, from a subsequent average score the players on the roster achieved over a period of time subsequent to the completion of the roster.

23. The gaming machine of claim 9, wherein the projected team score is estimated, at least in part, from a prior average score the players on the roster achieved over a period of time prior to the creation of the roster, and wherein the actual team score is calculated, at least in part, from a subsequent average score the players on the roster achieved over a period of time subsequent to the completion of the roster.

24. The method of claim 15, further comprising receiving selections from the user of one or more competing rosters; and determining an actual team score for each of the selected competing rosters, wherein the predetermined criterion is the actual team score of the roster exceeding any one of the actual team scores of the selected competing rosters.

* * * * *